US008424161B2

(12) United States Patent
Sutterlütti

(10) Patent No.: US 8,424,161 B2
(45) Date of Patent: Apr. 23, 2013

(54) FURNITURE HINGE

(75) Inventor: Harald Sutterlütti, Fussach (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/215,504

(22) Filed: Aug. 23, 2011

(65) Prior Publication Data

US 2011/0298349 A1 Dec. 8, 2011

Related U.S. Application Data

(63) Continuation of application No. PCT/AT2010/000080, filed on Mar. 17, 2010.

(30) Foreign Application Priority Data

Mar. 25, 2009 (AT) ..... A 477/2009

(51) Int. Cl.
*E05F 3/00* (2006.01)

(52) U.S. Cl.
USPC ..... 16/286; 16/50; 16/82; 16/84

(58) Field of Classification Search ..... 16/286, 16/84, 85, 50, 235–240, 54, 82, 86 A, 86 B, 16/86 C, 86 R
See application file for complete search history.

(56) References Cited

U.S. PATENT DOCUMENTS

| | | | | |
|---|---|---|---|---|
| 4,257,581 | A * | 3/1981 | Keeler, II | 267/116 |
| 5,269,043 | A * | 12/1993 | Yang | 16/68 |
| 6,957,807 | B2 * | 10/2005 | Zimmer et al. | 267/64.11 |
| 7,065,833 | B2 * | 6/2006 | Kropf | 16/286 |
| 7,096,535 | B2 * | 8/2006 | Lin | 16/287 |
| 7,406,749 | B2 * | 8/2008 | Herper | 16/368 |
| 7,562,757 | B2 * | 7/2009 | Dubach et al. | 192/215 |
| 7,730,583 | B2 * | 6/2010 | Salice | 16/286 |
| 7,748,082 | B2 * | 7/2010 | Harald et al. | 16/286 |
| 2003/0200625 | A1 * | 10/2003 | Zimmer | 16/306 |
| 2008/0121490 | A1 * | 5/2008 | Dubach et al. | 192/17 D |

(Continued)

FOREIGN PATENT DOCUMENTS

| | | |
|---|---|---|
| AT | 5477 | 6/1901 |
| AT | 6499 | 11/2003 |

(Continued)

OTHER PUBLICATIONS

International Search Report issued Jul. 19, 2010 in International (PCT) Application No. PCT/AT2010/000080.

*Primary Examiner* — Victor Batson
(74) *Attorney, Agent, or Firm* — Wenderoth, Lind & Ponack, L.L.P.

(57) ABSTRACT

A furniture hinge includes a fitting part and a hinge cup that is pivotably connected thereto by way of at least one articulated lever. The articulated lever is connected to the hinge cup by way of an articulated axis (A). A cushioning apparatus can be actuated by an actuating element and is provided to cushion a relative movement between the fitting part and the hinge cup. The actuating element is mounted inside the hinge cup rotatably about a rotational axis (S) extending substantially parallel to the articulated axis (A) of the hinge cup, and the cushioning apparatus includes at least one linear cushioning member having at least one linearly displaceable plunger. A transmission mechanism converts a rotary movement of the actuating element into a linear movement of the plunger of the linear cushioning member.

24 Claims, 7 Drawing Sheets

U.S. PATENT DOCUMENTS

| | | | | |
|---|---|---|---|---|
| 2008/0172834 | A1* | 7/2008 | Sutterlutti | 16/286 |
| 2008/0209674 | A1* | 9/2008 | Harald et al. | 16/82 |
| 2009/0119875 | A1* | 5/2009 | Migli | 16/233 |
| 2011/0005032 | A1* | 1/2011 | Domenig et al. | 16/54 |
| 2011/0072617 | A1* | 3/2011 | Lin et al. | 16/298 |
| 2011/0154609 | A1* | 6/2011 | Liao | 16/54 |

FOREIGN PATENT DOCUMENTS

| | | |
|---|---|---|
| AT | 010 222 | 11/2008 |
| DE | 203 20 810 | 4/2005 |
| DE | 20 2006 013 361 | 1/2008 |
| DE | 10 2007 037 480 | 3/2008 |
| WO | 2004/020771 | 3/2004 |
| WO | 2007/038815 | 4/2007 |
| WO | 2007/131933 | 11/2007 |
| WO | 2008/025596 | 3/2008 |
| WO | 2008/104009 | 9/2008 |

* cited by examiner

FURNITURE HINGE

This application is a Continuation of U.S. application Serial No. PCT/AT2010/000080, filed Mar. 17, 2010, the entire disclosure of which is incorporated herein by reference.

BACKGROUND OF THE INVENTION

The present invention concerns a furniture hinge comprising a fitment portion and a hinge cup pivotably connected thereto by way of at least one hinge lever. The hinge lever is connected to the hinge cup by way of a hinge axis, and a damping device is actuable by an actuating element for damping a relative movement between the fitment portion and the hinge cup. The actuating element is mounted within the hinge cup rotatably about an axis of rotation extending substantially parallel to the hinge axis of the hinge cup, and the damping device has at least one linear damper which is arranged at the outside of the hinge cup and has at least one linearly displaceable piston.

The invention further concerns an article of furniture having a movable furniture part mounted movably by way of at least one furniture hinge of the kind to be described.

The damping action of a linear damper is essentially based on the flow resistance of a damping fluid in a fluid chamber. Damping devices having a piston with a linear damping stroke usually have a travel-dependent damping function (that is to say, the degree of damping is dependent on the available damping stroke of the piston). Thus, a sufficient damping travel is accordingly to be provided to achieve the desired soft damping of a relative movement between the fitment portions. A particular requirement is therefore that of arranging the damping device in as space-saving a fashion as possible and inconspicuously on the hinge cup, but at the same time also ensuring an adequate damping stroke and thus a satisfactory damping action in respect of the furniture hinge.

A furniture hinge having a hinge cup and a linear damper arranged at the outside of the hinge cup is known for example from WO 2008/104009 A1 to the present applicant. The linear damper in that case can have a linearly displaceable piston, the direction of the linear movement of the piston being oriented substantially parallel to a hinge axis of the hinge.

WO 2007/038815 A1 to the present applicant also shows in FIGS. 32 through 37 a furniture hinge having a linear damper which can be acted upon by way of an actuating element mounted in the hinge cup. In that case the linear damper is concealed under a cover housing which is fitted onto the hinge cup.

SUMMARY OF THE INVENTION

Therefore, the object of the present invention is to propose a furniture hinge of the general kind mentioned in the opening part of this specification, wherein the damping device can be arranged on the hinge cup in an efficient and inconspicuous fashion.

According to the invention, that object is achieved by the features described below. Further advantageous configurations of the invention are recited in the appendant claims.

According to the invention, there is provided a transmission mechanism which converts a rotary movement of the actuating element into a linear movement of the piston of the linear damper. The hinge cup and the linear damper or dampers arranged on the hinge cup are arranged in the installation position all within a cylindrical bore in the furniture part.

The pivotally mounted actuating element can be caused to perform a rotary movement as from a predetermined relative position of the fitment portions with respect to each other. The actuating element can be acted upon by a hinge lever of the hinge and/or the carcass-side fitment portion (for example, the hinge arm). The transmission mechanism can convert that rotary movement of the actuating element into a linear movement of the piston. The transmission mechanism can therefore transform a relatively slight rotary movement of the actuating element into an increased linear movement of the piston. In that way, it is possible to achieve an enhanced damping travel and consequently also an enhanced damping action on the part of the linear damper, whereby it is possible to provide for efficient movement damping of the movable furniture part. In that case, the damping range of the movable furniture part can begin to act as from an angular position of greater than or equal to 35° in relation to the complete end position.

In a possible embodiment, the hinge cup can have at least one laterally projecting fixing flange, wherein the damping device is arranged beneath the fixing flange and at the outside of the hinge cup. In that way, on the one hand, it is possible to provide for a very compact installation of the damping device, while on the other hand, the damping device does not appear at all externally in the case of a hinge cup when fitted into a standard bore. The damping device can therefore be arranged as a whole structural unit beneath the plane formed by the opening of the hinge cup.

In a preferred embodiment of the invention, the direction of the linear movement of the piston can extend transversely, preferably substantially at a right angle, to the hinge axis at the hinge cup side. In that case, the linear movement of the piston or pistons can be substantially horizontal, that is to say substantially parallel to a support surface of the fixing flange which in the mounted position bears against a surface of the movable furniture part.

A particular advantage is afforded in that the hinge cup together with a housing of the damping device, that at least partially encloses the hinge cup, can be received as a common structural unit in a bore of predetermined nominal diameter, wherein the fixing flange in the mounted position substantially completely covers the housing of the damping device. In that case, the housing of the damping device is disposed externally on the hinge cup, that is to say outside the internal cavity in the hinge cup, in which at least one hinge lever of the furniture hinge is immersed in the closing movement. The actuating element of the damping device can be mounted movably within the hinge cup or can extend into the internal cavity in the hinge cup so that it can be actuated by the hinge lever and/or by a fitment portion as from a predetermined angular position of the furniture hinge. In that arrangement, the actuating element is mounted on the hinge cup rotatably about a horizontal axis. The rotary angle range of the actuating element in that case is between 70° and 170°, and preferably between 130° and 160°.

In a preferred embodiment, the piston of the linear damper is guided displaceably in a fluid chamber. The fluid chamber can in that case be in the form of a cavity in a housing of the damping device or alternatively it can be formed by a cavity in a cylinder in which the piston is linearly displaceably guided. The linear damper is desirably in the form of a fluid damper filled with a liquid or gaseous damping medium.

In a desirable configuration, the actuating element is operatively connected to the piston of the linear damper at least in the damping stroke of the damping device. In that way, the piston of the linear damper can be motionally coupled to the actuating element so that, upon a rotary movement of the actuating element, the piston of the linear damper is also moved therewith, that is to say it is displaced linearly within the fluid chamber. The actuating element can also be motionally coupled constantly to the piston of the linear damper by way of the transmission mechanism. The continuous coupling between the actuating element and the piston of the linear damper can provide that force is applied directly to the linear damper in the damping stroke, whereas in the return stroke the actuating element can be moved back again into a position for the next damping stroke, by a return mechanism associated with the linear damper. In that way, a specific return mechanism for the actuating element is not necessarily required.

In a preferred embodiment of the invention, a side wall of the hinge cup can have an opening, wherein the transmission mechanism extends from the inside of the hinge cup through the opening to the outside of the hinge cup. In that respect, it may be desirable if the transmission mechanism has at least one lever which is hingedly connected to the actuating element and which is connected (also hingedly) to the piston of the linear damper or can be coupled thereto at least at times. In the damping stroke the lever is operatively connected, on the one hand, to the actuating element, and on the other hand it is operatively connected by way of a piston rod associated with the piston of the linear damper. The piston rod can also have a cranked (bent) shape, wherein the piston rod extends through the opening from the inside of the hinge cup to the outside thereof, by virtue of the cranked shape. In the configuration just described, the transmission mechanism includes the lever and the piston rod of the linear damper. The piston and the piston rod can, in that case, also have an integral configuration—for example in the form of integral injection molding of plastic material.

In a possible embodiment of the invention, the outside of the hinge cup has at least one flat face which makes it possible to mount the damping device. In a development of the invention, the hinge cup can have oppositely disposed side walls, wherein the side walls at the outside thereof each have a respective flat surface provided for the arrangement of separate damping devices. In a preferred embodiment of the invention, the hinge cup at the outside thereof can have a respective damping device, wherein the hinge cup together with the damping devices arranged thereon can be jointly inserted within a standard bore provided on a furniture part and is arranged within a notional bore diameter of the standard bore.

To provide an additional damping force, each damping device can have a first and a second fluid chamber which are filled with damping fluid and which are connected together by a passage. In this connection, it may be desirable if a piston can immerse into the first fluid chamber, the volume of the first fluid chamber being changeable by the piston. A device can be arranged in the second fluid chamber, which is deformable or movable by a flow of damping fluid into or out of the second fluid chamber, to change the volume of the second fluid chamber. The device can have either a deformable compressible material portion arranged in the second fluid chamber or alternatively a piston displaceable in the second fluid chamber.

The two fluid chambers are therefore connected in serial relationship and are in fluid-conducting communication by way of the at least one passage. The damping fluid of the first fluid chamber, that is displaced by the first piston during the damping stroke, also flows through the passage into the second fluid chamber—apart from a possible residual compressibility of the damping fluid, wherein the volume of the second fluid chamber can be changed by the fluid pressure. The second fluid chamber thus forms a compensating space for the displaced damping fluid, that is variable during compression or decompression. The second fluid chamber can be arranged in a very compact structure relative to the first fluid chamber, whereby it is possible to achieve particularly small constructions for the damping device. In principle, the passage connecting the two fluid chambers can also have a very short length (for example, in the form of a hole in the function of an overflow opening). It is preferably provided that the passage connecting the two fluid chambers extends from the bottom region of the first fluid chamber to the inlet region of the second fluid chamber.

BRIEF DESCRIPTION OF THE DRAWINGS

Further details and advantages of the present invention are described by means of the specific description hereinafter, in which.

DETAILED DESCRIPTION OF THE INVENTION

Figure 1:
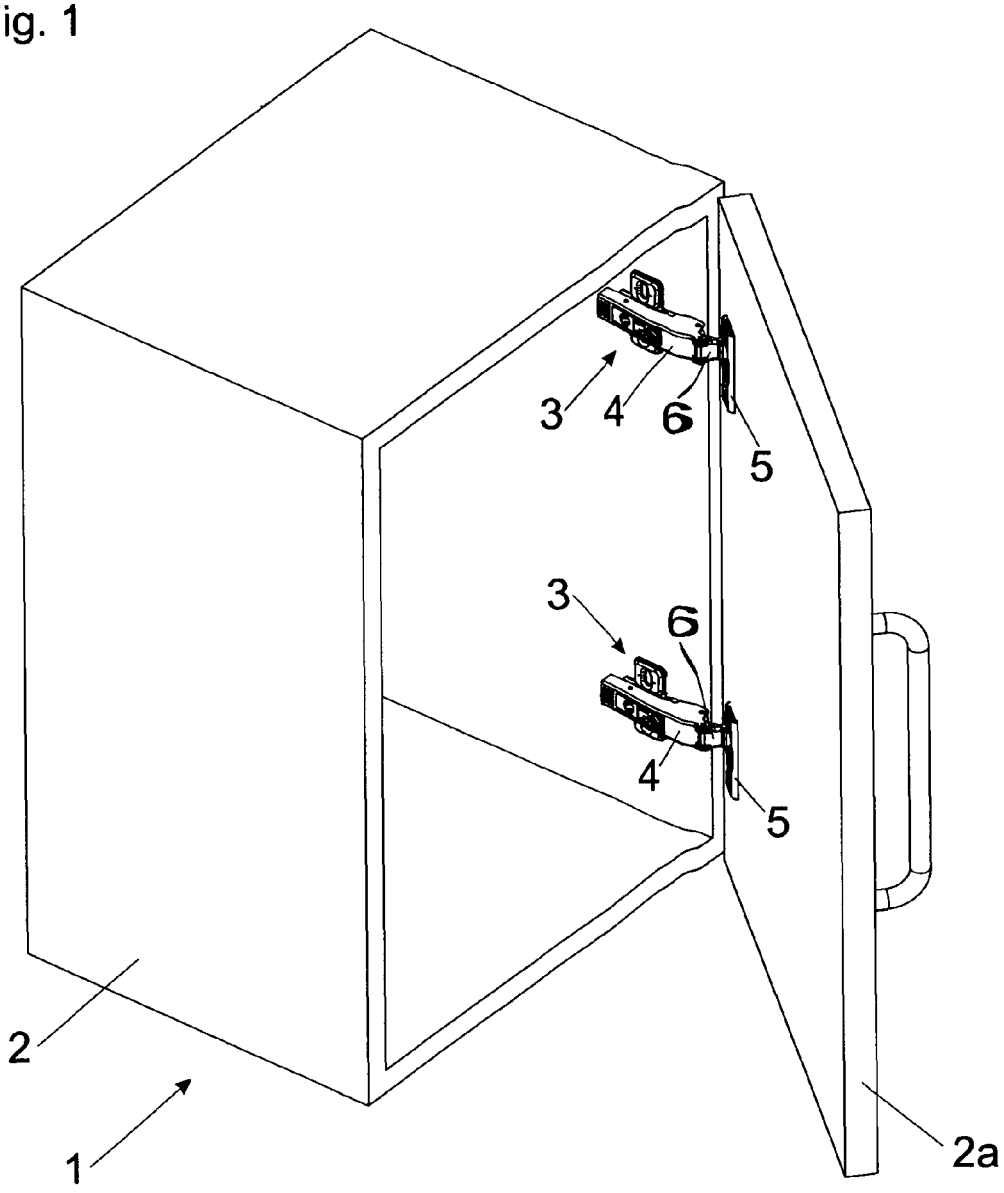
FIG. 1 shows a perspective view of an article of furniture having a movable furniture part pivotably mounted to the furniture carcass by way of furniture hinges according to the invention.

FIG. 1 shows a perspective view of an article of furniture 1 with a furniture carcass 2, wherein a movable furniture part 2*a* is pivotably mounted to the furniture carcass 2 by way of furniture hinges 3 according to the invention. The illustrated furniture hinges 3 each include a carcass fitment portion 4 in the form of a hinge arm and a hinge cup 5 sunk in a bore in the movable furniture part 2*a*. The hinge cup 5 is connected to the carcass fitment portion 4 pivotably by way of at least one hinge lever 6. The furniture hinge 3 includes a damping device (not visible here) whereby the movement of the movable furniture part 2*a* can be damped towards the end of the closing movement and/or towards the end of the opening movement until the complete end position is reached.

Figure 2:
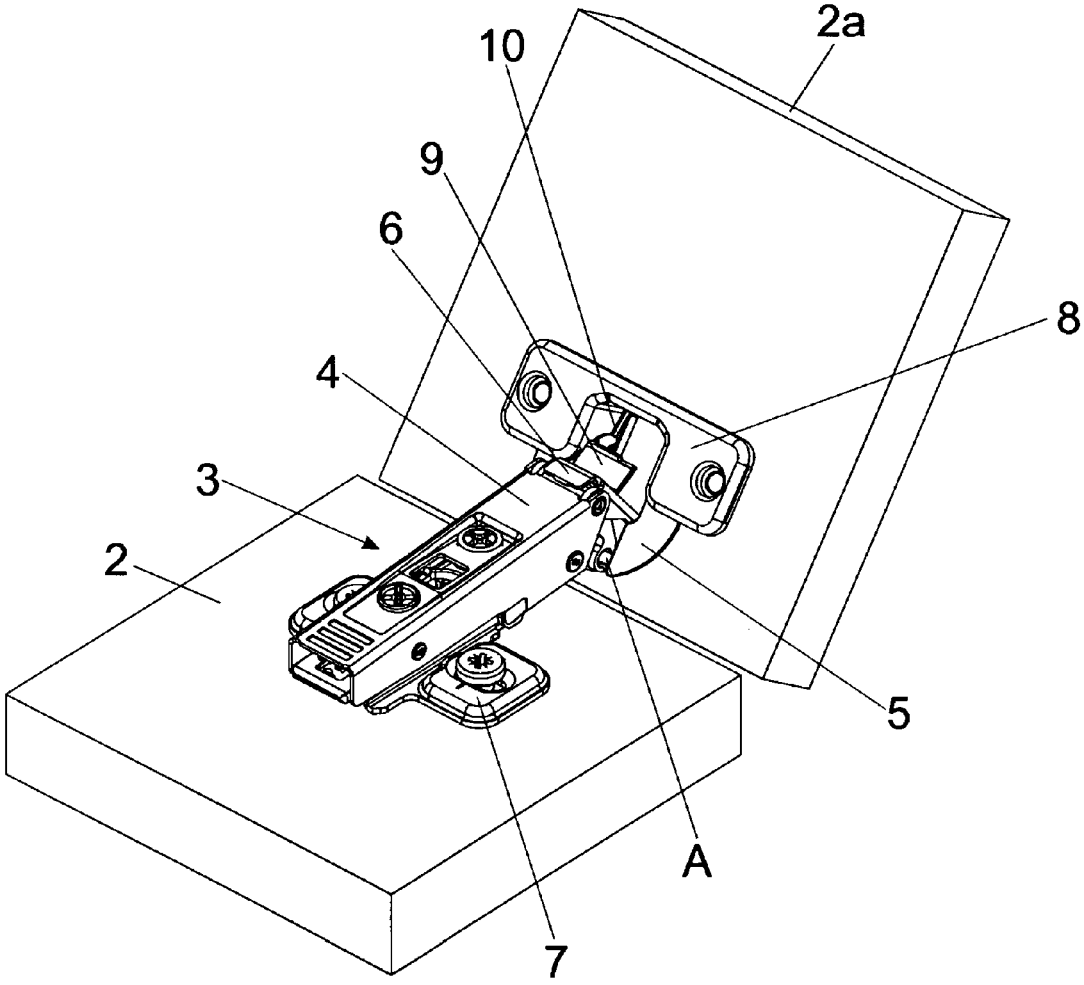
FIG. 2 shows a perspective view of the furniture hinge in an open position.

FIG. 2 shows the furniture hinge 3 in an open position. Fixed to the furniture carcass 2 is a base plate 7 which can be releasably latched to the fitment portion 4 in the form of the hinge arm. The hinge cup 5 is sunk in a standard bore provided in the movable furniture part 2*a*, and has a fixing flange 8, by which the hinge cup 5 can be fixed to the movable furniture part 2*a*. It is possible to see an actuating element 9 which is mounted in the internal cavity in the hinge cup 5 rotatably about an axis extending substantially parallel to a hinge axis (A) of the furniture hinge 3. Towards the end of the closing movement of the furniture hinge 3, the rotatably mounted actuating element 9 is acted upon by the outer hinge lever 6 and thereby caused to rotate. It is also possible to see a lever 10 which is hingedly connected to the actuating element 9 and which forms a part of the transmission mechanism and which is provided to convert a rotary movement of the actuating element 9 into a linear piston movement of the linear damper (not visible here).

Figure 3A:
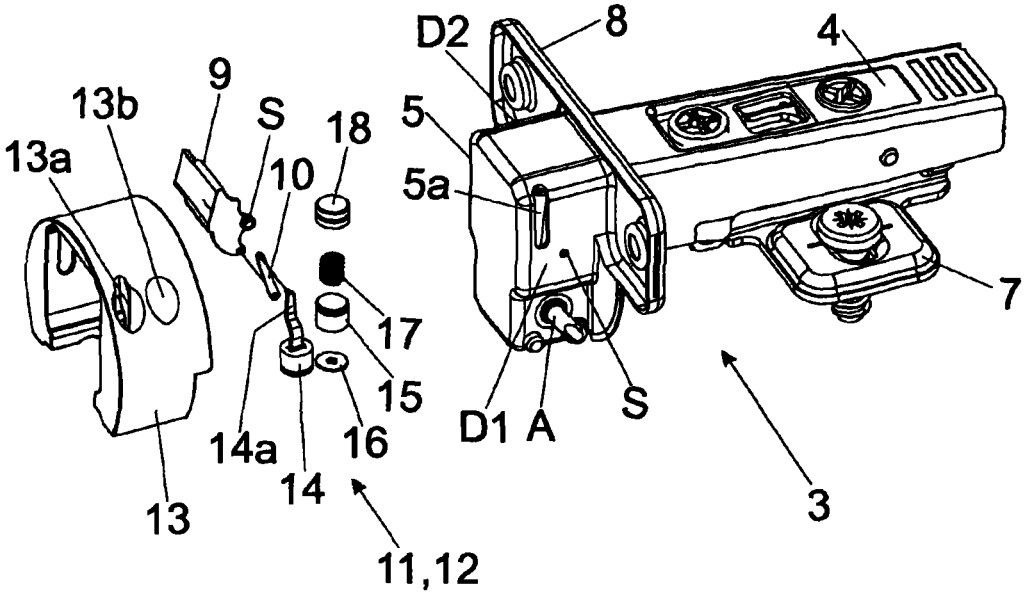
FIGS. 3*a*, 3*b* show a perspective view and a sectional view of the hinge cup in the exploded condition of the furniture hinge.

FIG. 3*a* shows an exploded perspective view of the furniture hinge 3. The fitment portion 4 in the form of the hinge arm can be snapped onto the base plate 7 (i.e., connected without separate fasteners). The hinge cup 5 has a fixing flange 8 for fixing to the movable furniture part 2*a*, wherein the damping device 11 is mounted in the mounted position at the outside of the hinge cup 5 and beneath the fixing flange 8. The damping device 11 is in the form of a linear damper 12 having a housing 13. The housing 13 which is in the shape of a circular arc has a first fluid chamber 13*a* in which a first piston 14 having a piston rod 14*a* is linearly displaceable. The piston rod 14*a* has a cranked (bent) shape so that in the mounted position, the piston rod 14*a* is disposed at least partially within an opening 5*a* associated with the hinge cup 5. The distal end of the piston rod 14*a*, remote from the first piston 14, is hingedly connected to a lever 10 to be arranged in the internal cavity in the hinge cup 5. The other end of the lever 10 is hingedly connected to the rotatable actuating element 9. The actuating element 9 is supported rotatably about an axis of rotation (S) within the hinge cup 5, wherein that axis of rotation (S) can also be seen on the hinge cup 5. In the illustrated embodiment, therefore, the transmission mechanism is formed by the lever 10 and the piston rod 14*a* hingedly connected thereto. When the actuating element 9 is acted upon by the hinge lever 6 (FIG. 2), the actuating element 9 is rotated relative to the hinge cup 5, in which case that rotary movement is transmitted by way of the lever 10 and the piston rod 14*a* to the piston 14 which is then displaced within the first fluid chamber 13*a*. In addition, the housing 13 has a second fluid chamber 13*b* in which a second piston 15 is linearly displaceable in a direction in opposite relationship to the first piston 14. The first fluid chamber 13*a* and the second fluid chamber 13*b* are in fluid-conducting communication with each other by way of a passage (not visible here) so that, in the damping stroke, the damping medium can pass from the first fluid chamber 13*a* by way of the passage and by way of a switching blade 16 having at least one through-flow opening into the second fluid chamber 13*b* so that the second piston 15 is urged upwardly within the second fluid chamber 13*b* against the force of the return spring 17. After the damping stroke has been performed, the second piston 15 is urged back again by the force of the return spring 17, whereupon the damping medium passes into the first fluid chamber 13*a* again by way of the passage and thereby moves the first piston 14 into the starting position again. By virtue of that return movement of the first piston 14, because of the permanent coupling (piston rod 14*a* and lever 10), the actuating element 9 is also moved back again into a starting position for the next damping stroke. In that way, it is sufficient if both the two pistons 14, 15 and also the actuating element 9 can be moved again back into the starting position for the next damping stroke by way of the provided return spring 17. It should be noted that the two pistons 14, 15 each terminate in sealing relationship with the inside wall of the two fluid chambers 13*a*, 13*b* so that the damping medium is disposed exclusively between the two pistons 14, 15. A sealing element 18 forms the upper termination of the second fluid chamber 13*b*. The linear movement of the two pistons 14, 15 extends substantially perpendicularly to a hinge axis (A) of the furniture hinge 3. At the outside of mutually opposite side walls, the hinge cup 5 has flat surfaces D1 and D2 for arranging the damping device 11. In plan view, therefore, the hinge cup 5 has at least approximately a rectangular configuration.

Figure 3B:
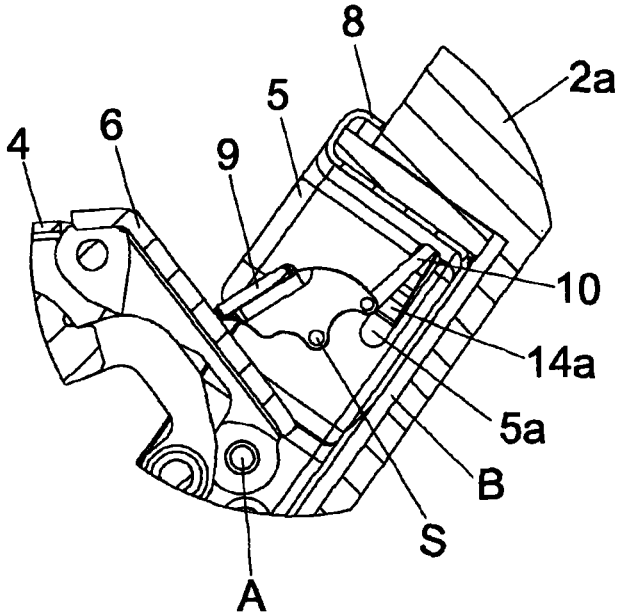

FIG. 3*b* shows a sectional view of the hinge cup 5 which is sunk in a bore (B) in the movable furniture part 2*a*. The hinge lever 6 connecting the carcass fitment portion 4 and the hinge cup 5 is mounted to the hinge cup 5 at a hinge axis A. The actuating element 9 mounted rotatably about the axis of rotation (S) is arranged pivotably at the inside of the internal cavity in the hinge cup 5. The lever 10 is hingedly connected to the actuating element 9. It is possible to see the piston rod 14*a* which is hingedly connected to the lever 10 by way of the opening 5*a* in the hinge cup 5. FIG. 3*b* shows the beginning of the damping process, wherein the hinge lever 6 is acting on the actuating element 9 and then pivots it in the clockwise direction. That movement is transmitted by way of the lever 10, in which case the piston rod 14*a* (and therewith the piston 14) is also moved so that the first piston 14 is displaced against the fluid pressure in the first fluid chamber 13*a*.

Figure 4A:
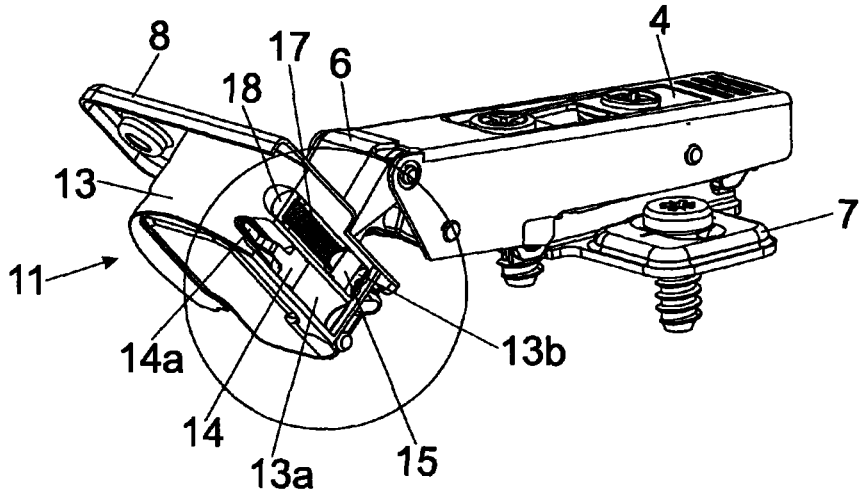
FIGS. 4*a*, 4*b* show a partly sectional view and an enlarged detail view of the furniture hinge with a damping device arranged at the outside.
Figure 4B:
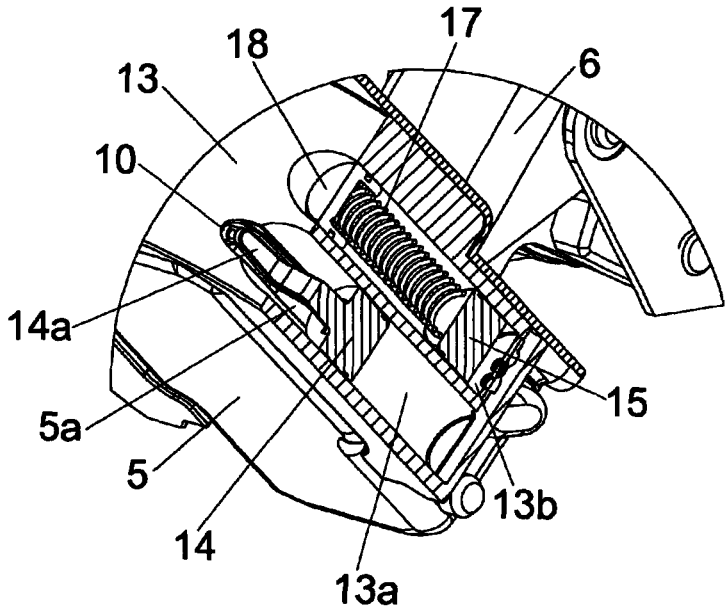

FIG. 4*a* shows a partly sectional view of the furniture hinge 3, wherein the damping device 11 in the installed position is mounted at the outside of the hinge cup 5 and is completely covered by the fixing flange 8. The housing 13 of the damping device 11 has a circular peripheral surface so that the hinge cup 5 together with the surrounding housing 13 of the damping device 11 is accommodated within the provided bore (B) (FIG. 3*b*) of a predetermined nominal diameter (for example 35 mm) of the movable furniture part 2*a*. FIG. 4*b* shows a view on an enlarged scale of the region circled in FIG. 4*a*. It is possible to see the hinge cup 5 with the opening 5*a* provided therein, the Figure also showing the hinged connection between the lever 10 and the piston rod 14*a* of the piston 14. When the actuating element 9 which is not visible here is acted upon by the hinge lever 6, the piston 14 is pushed into the first fluid chamber 13*a* by way of the lever 10 and the piston rod 14*a*. The first fluid chamber 13*a* is in fluid-conducting communication with the second fluid chamber 13*b* so that the damping medium which is displaced in the course of the damping stroke, of the first fluid chamber 13*a*, passes into the second fluid chamber 13*b* and thus urges the second piston 15 upwardly against the force of the return spring 17.

Figure 5:
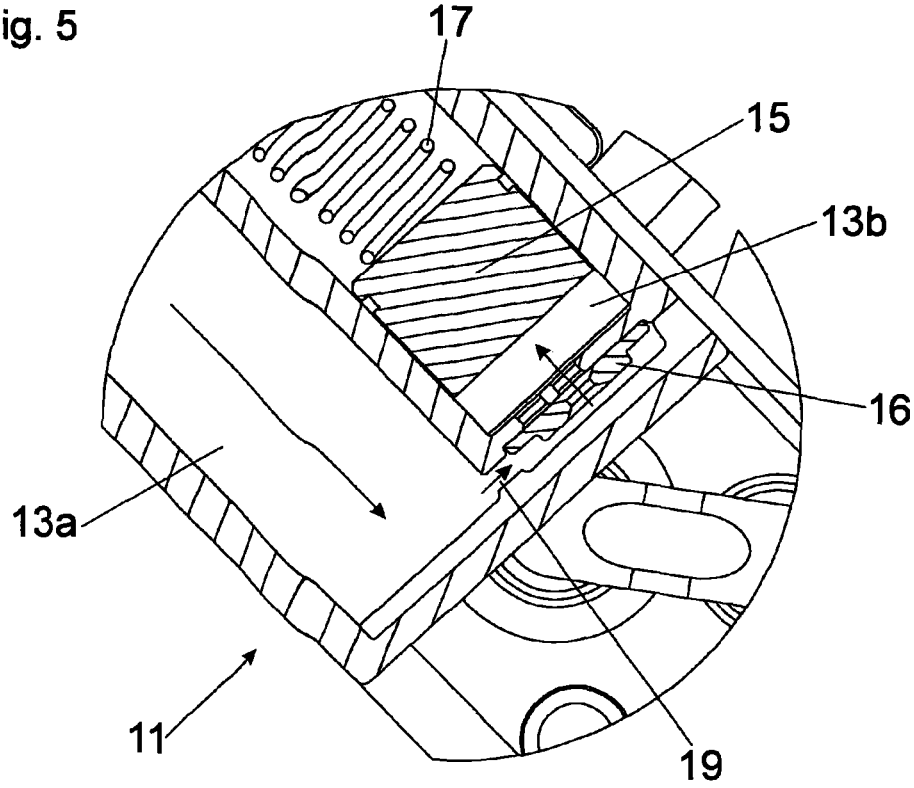
FIG. 5 shows a sectional view of a damping device with two fluid chambers connected together by a passage.

FIG. 5 shows a sectional view of a damping device 11 having the first fluid chamber 13*a* in which the first piston 14 (not visible here) is linearly displaceably guided. The illustrated Figure represents the position of the second piston 15 at the beginning of the damping stroke, the second piston 15 being linearly displaceably guided in the second fluid chamber 13*b*. The direction of movement of the first piston 14 is substantially parallel to that of the second piston 15 and in the opposite direction. The illustrated arrows clearly show the flow direction of the damping fluid during the damping stroke. In the damping stroke, the damping medium is pressed from the first fluid chamber 13*a* by way of a passage 19 and by way of a switching blade 16 provided with at least one through-flow opening into the second fluid chamber 13*b*, whereupon the second piston 15 is displaced rearwardly against the force of the return spring 17. After the damping stroke, the return spring 17 can move the second piston 15 in the opposite direction again so that the damping medium passes back again into the first fluid chamber 13*a* in the opposite direction to the indicated arrows, and thereby urges the first piston 14 (and therewith the motionally coupled actuating element 9) into the starting position again for the next damping stroke. Instead of the second piston 15 it is also possible to arrange a device in the second fluid chamber 13*b*, which device is deformable or movable to change the volume of the second fluid chamber 13*b*. For example, instead of the second piston 15 it is possible to use a compressible material portion (for example a TPU portion or foam rubber) which is compressible during the damping stroke. In such a configuration, the return spring 17 is to be arranged in the first fluid chamber 13*a*, in which case in the return stroke of the return spring 17 the damping fluid is drawn by reduced pressure again from the second fluid chamber 13*b* into the first fluid chamber 13*a*.

Figure 6:
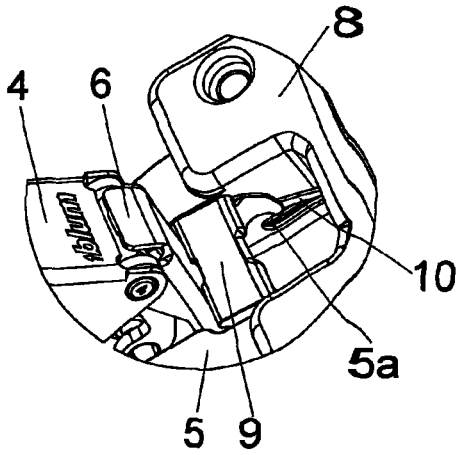
FIG. 6 shows a perspective view from above of the hinge cup with an actuating element of the damping device, that is mounted therein.

FIG. 6 shows a perspective view from above of the hinge cup 5, the damping device 11 (not visible here) being arranged in the mounted position beneath the fixing flange 8 and at the outside of the hinge cup 5. The Figure clearly shows the rotatable actuating element 9 which can be acted upon by the hinge lever 6 towards the end of the closing movement of the furniture hinge 3. The resulting rotation of the actuating element 9 also pulls the lever 10 towards the left, wherein the piston rod 14*a* of the piston 14, that is hingedly connected to the lever 10, is also displaceable within the slot-shaped opening 5*a* in the hinge cup 5. The hinge lever 6 is not connected to the actuating element 9, and the actuating element 9 of the damping device 11 is first acted upon as from a predetermined relative position of the hinge cup 5 with respect to the fitment portion 4 and is then urged into the hinge cup 5. That movement of the actuating element 8 (and therewith the closing movement of the furniture hinge 3) can also be damped by the damping device 11.

Figure 7:
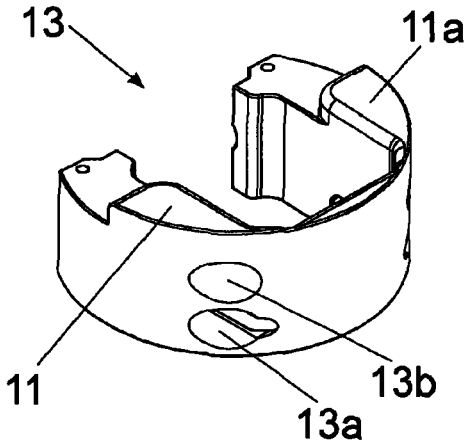
FIG. 7 shows a possible embodiment of a housing of the damping device, which can be sunk together with the hinge cup in a circular bore of the movable furniture part.

FIG. 7 shows a perspective view of the housing 13 which is adapted to receive two oppositely disposed damping devices 11 and 11*a*. The damping devices 11 and 11*a* can each be identical so that a total of four pistons—which are displaceable in four different fluid chambers—are available for damping a hinge movement. The Figure diagrammatically indicates the two fluid chambers 13*a* and 13*b* which obviously are to be closed by suitable sealing elements so that the damping fluid arranged in the two fluid chambers 13*a* and 13*b* cannot escape. The housing 13 has a circular outside peripheral surface so that it can be sunk in a standard bore (B) provided in the movable furniture part. The housing 13 together with the damping devices 11 arranged therein is thus disposed so that the housing 13 is supported beneath the fixing flange 8 and thus does not project beyond the remaining components of the furniture hinge 3. In the illustrated embodiment, the housing 13 which embraces the hinge cup 5 in a clip-like configuration is in one piece with the damping devices 11, 11*a*. It will be appreciated that it is also possible for the two damping devices 11 and 11*a* to be respectively disposed in a separate housing, which housings can then be arranged as separate units at the flat surfaces D1 and D2 identified in FIG. 3*a*.

Figure 8A:
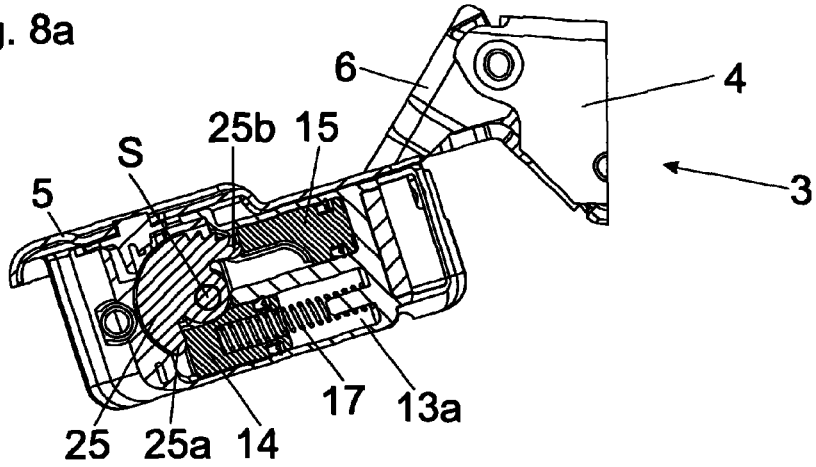
FIGS. 8*a*-8*c* show a further embodiment of the invention, wherein the transmission mechanism has a rotatably mounted lever by which at least one piston of the damping device is movable.
Figure 8B:
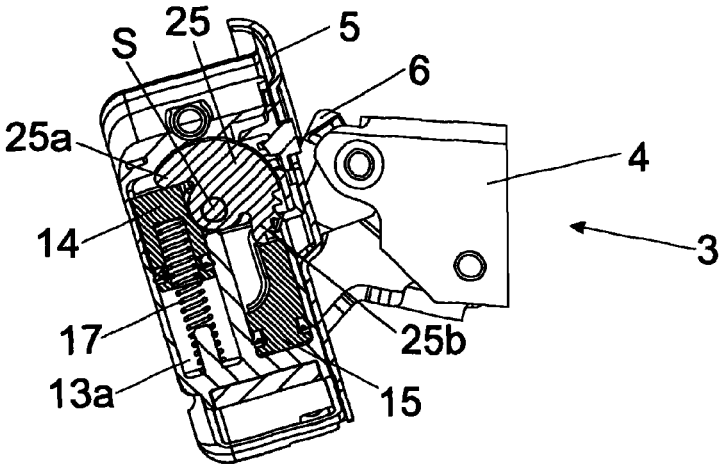
Figure 8C:
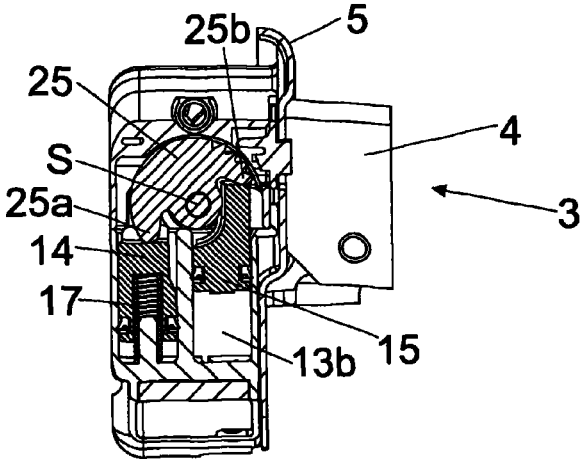

FIGS. 8*a*-8*c* show a somewhat modified embodiment of the transmission mechanism for converting a rotary movement of the actuating element 9 into a linear movement of the piston 14. In particular, the transmission mechanism has a lever 25 mounted pivotally about the axis of rotation (S) instead of the previously illustrated lever 10 and the piston rod 14. The axis of rotation (S) is arranged coaxially with the axis of rotation of the actuating element 9 mounted in the interior of the hinge cup 5, wherein the actuating element 9 and the pivotable lever 25 can be mounted on a common shaft and are non-rotatably connected together. In a movement of the actuating element 9, therefore, the lever 25 is also rotated about the axis of rotation (S). The lever 25 is mounted outside the hinge cup 5 and can be mounted in the housing 13 shown in FIG. 7. The lever 25 serves to act on at least one piston 14, in the illustrated embodiment, but it serves to control the linear movement of both pistons 14, 15. The lever 25 rotatable about the axis of rotation (S) has two lever arms 25*a*, 25*b* which respectively bear loosely against the two displaceable pistons 14 and 15. The lever 25 can possibly also be connected—in particular, hingedly—to the two pistons 14, 15, which connection can also be made by way of an additional lever and/or by way of a piston rod. FIG. 8*a* shows the open position of the furniture hinge 3. In the closing movement of the furniture hinge 3, the hinge lever 6 encounters the actuating element 9 mounted rotatably in the hinge cup 5 (FIGS. 3*b* and 8*b*). In the further closing movement of the hinge 3, the lever 25 is also rotated in the counter-clockwise direction. The piston 14 is urged into the first fluid chamber 13*a* by the lever arm 25*a* of the lever 25, and the second piston 15 is also displaced in the opposite direction within the second fluid chamber 13*b* through the passage 19 (not visible here; see FIG. 5) (FIG. 8*c*). After the damping stroke has taken place, the return spring 17 urges the first piston 14 in the fluid chamber 13*a* back into the starting position again, in which case the lever 25 is also rotated back in the clockwise direction by the pressure on the lever arm 25*a*. Due to that return movement, the second piston 13*b* in the fluid chamber 13*b* is also moved back into the starting position (that is to say it is pushed into the fluid chamber 13*b*). At the same time, the actuating element 9 coupled to the lever 25 is also returned within the hinge cup 5 into a readiness position for the next damping stroke.

Figure 9A:
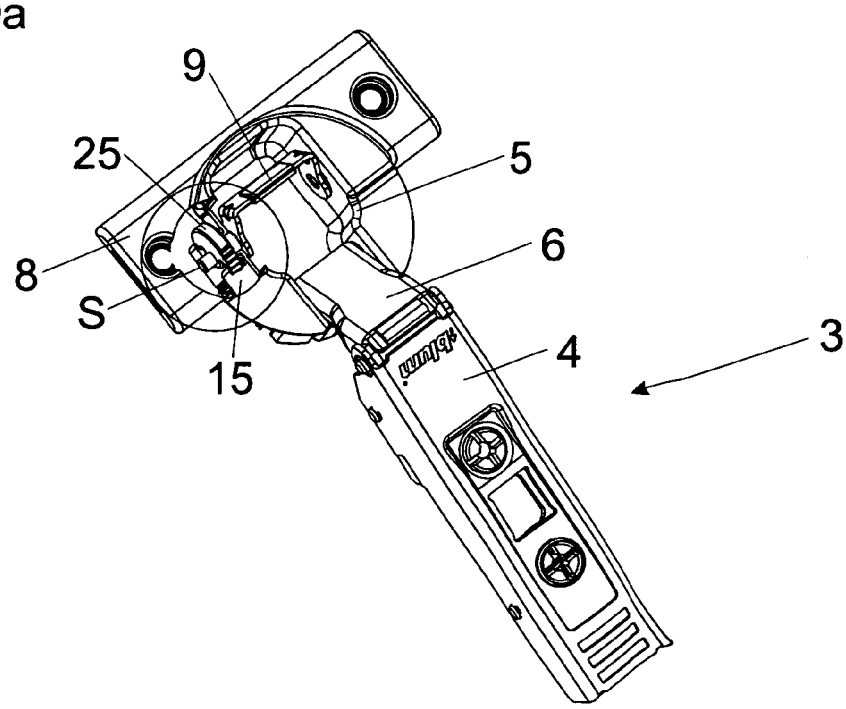
FIGS. 9*a*, 9*b* show a perspective view and an enlarged detail view thereof of the furniture hinge with the transmission mechanism as shown in FIGS. 8*a*-8*c*.

FIG. 9*a* shows a perspective and partly broken-away view from above of the furniture hinge 3. The fitment portion 4 in the form of the hinge arm is hingedly connected to the hinge cup 5 by way of at least one hinge lever 6. It is possible to see the actuating element 6 which is pivotable about the axis of rotation (S) and which can be caused to perform a pivotal movement towards the end of the closing movement of the hinge 3 by the hinge lever 6. Mounted at the outside of the hinge cup 5 is the lever 25 which is motionally coupled to the actuating element 9 so that in a rotary movement of the actuating element 9, the lever 25 is also moved. The movement of at least one piston 15 of the linear damper can be caused to occur by the lever 25. The hinge cup 5 and the linear damper or dampers 12 arranged on the hinge cup 5 are all arranged in the installation position within a cylindrical bore (B) in the furniture part 2*a* (see FIG. 3*b*).

Figure 9B:
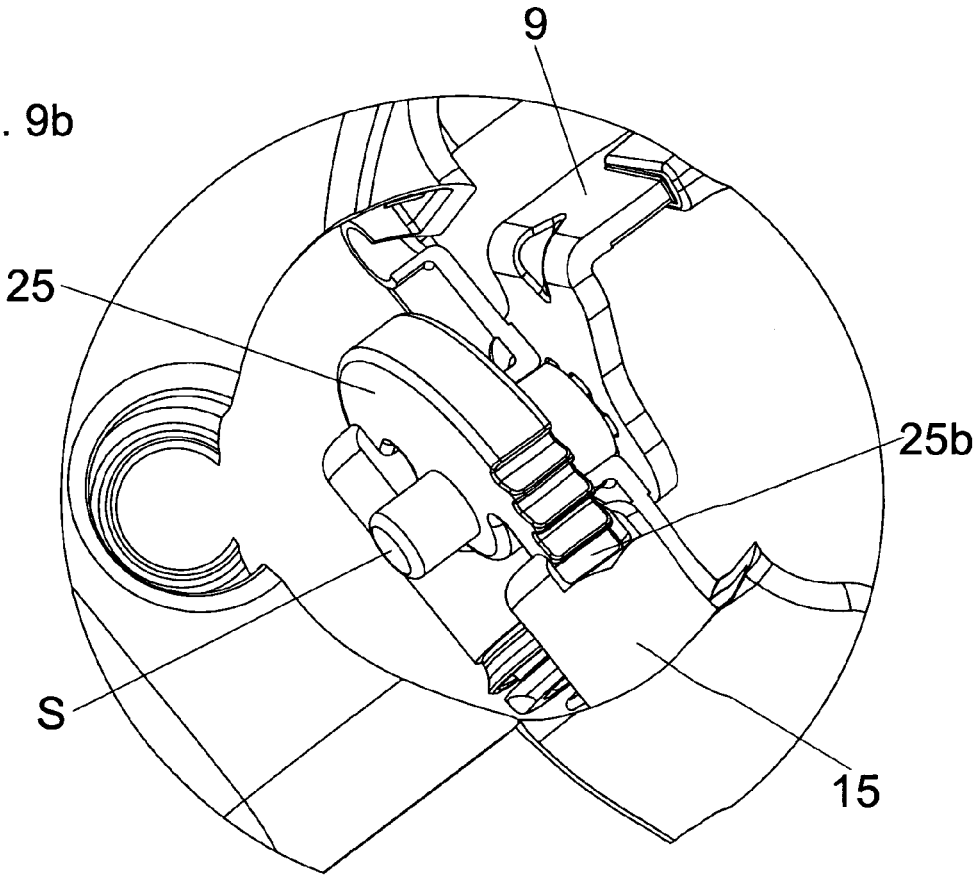

FIG. 9*b* shows a view on an enlarged scale of the broken-away detail of FIG. 9*a*. The actuating element 9 mounted in the hinge cup 5 and the lever 25 mounted at the outside of the hinge cup 5 are mounted rotatably about a common axis of rotation (S). The lever 25*b* has a lever arm 25*b* which bears against the upper piston 15 and which can be returned again to a starting position for the next damping stroke after a damping stroke has been effected (due to the force of the return spring 17 shown in FIGS. 8*a*-8*c*). The lever 25 further has a second lever arm 25*a* by which the lower piston 14 can be urged into the fluid chamber 13*a* in the damping stroke (FIGS. 8*a*-8*c*).

The present invention is not limited to the illustrated embodiments, and includes or extends to all variants and technical equivalents which can fall within the scope of the appended claims. The positional references adopted in the description such as for example up, down, lateral and so forth are also related to the directly described and illustrated Figure and are to be appropriately transferred to the new position upon a change in position.

The invention claimed is:

1. A furniture hinge comprising:

a fitment portion;

a hinge lever;

a hinge cup pivotally connected to said fitment portion by said hinge lever, said hinge lever being connected to said hinge cup by a hinge axis;

a damping device comprising a linear damper arranged at an outside surface of said hinge cup, and said linear damper including a linearly displaceable piston;

an actuating element configured to actuate said damping device so as to dampen a relative movement between said fitment portion and said hinge cup, said actuating element being entirely and continuously arranged within said hinge cup, said actuating element being pivotally mounted so as to be rotatable about an axis of rotation extending substantially parallel to said hinge axis of said hinge cup;

a transmission mechanism configured to convert a rotary movement of said actuating element into a linear movement of said piston of said linear damper; and a housing, said linear damper being arranged within said housing, said housing being fitted onto an outer surface of said hinge cup so as to be insertable jointly with said hinge cup within a cylindrical bore in a furniture part.

2. The furniture hinge of claim 1, wherein said hinge cup has at least one laterally projecting fixing flange, said damping device being arranged adjacent to a furniture-facing surface of said fixing flange and at said outside surface of said hinge cup.

3. The furniture hinge of claim 1, wherein said linear damper further includes a fluid chamber, said piston being guided displaceably in said fluid chamber.

4. The furniture hinge of claim 1, wherein a direction of linear movement of said piston is substantially perpendicular to said hinge axis.

5. The furniture hinge of claim 1, wherein said linear damper comprises a fluid damper.

6. The furniture hinge of claim 1, wherein said actuating element is configured and arranged to be acted upon during a hinge movement by one of said fitment portion and said hinge lever.

7. The furniture hinge of claim 1, wherein, at least during a damping stroke of said damping device, said actuating element is operatively connected to said piston of said linear damper.

8. The furniture hinge of claim 1, wherein said actuating element is motionally continuously coupled to said piston of said linear damper by said transmission mechanism.

9. The furniture hinge of claim 1, wherein a side wall of said hinge cup has an opening, said transmission mechanism arranged so as to extend from an inside of said hinge cup through said opening to an outside of said hinge cup.

10. The furniture hinge of claim 1, wherein said transmission mechanism has a lever hingedly connected to said actuating element and connected to said piston of said linear damper.

11. The furniture hinge of claim 10, wherein said lever is connected to a piston rod of said piston.

12. The furniture hinge of claim 11, wherein said piston rod has a bent shape so as to extend through an opening of said hinge cup from an inside of said hinge cup to an outside of said hinge cup.

13. The furniture hinge of claim 1, wherein said piston of said linear damper has a piston rod, said piston and said piston rod have a one-piece construction.

14. The furniture hinge of claim 1, wherein said hinge cup has an outer flat surface, said damping device being arranged at said outer flat surface of said hinge cup.

15. The furniture hinge of claim 1, wherein said hinge cup has oppositely-located side walls, each of said side walls having an outer flat surface, said linear damper of said damping device comprising a first linear damper located at said outer flat surface of a first one of said side walls, said damping device further comprising a second linear damper located at said outer flat surface of a second one of said side walls.

16. The furniture hinge of claim 1, wherein said housing has an arc-shaped outer surface, said linear damper being arranged within said arc-shaped housing, said arc-shaped housing being fitted around an outer surface of said hinge cup so as to be insertable jointly with said hinge cup within the bore of the furniture part.

17. The furniture hinge of claim 1, wherein said linear damper has a first fluid chamber and a second fluid chamber each filled with damping fluid and connected together by a passage so as to communicate with each other.

18. The furniture hinge of claim 17, wherein said piston is movably mounted within said first fluid chamber so as to change a volume of said first fluid chamber when moving, said linear damper further including a volume-changing device within said second fluid chamber, said device being deformable or movable by a flow of said damping fluid into or out of said second fluid chamber so as to change a volume of said second fluid chamber.

19. The furniture hinge of claim 18, wherein said volume-changing device comprises one of a deformable material portion and a displaceable piston.

20. The furniture hinge of claim 1, wherein said piston of said linear damper comprises a first piston, said linear damper further including a second piston having a linear damping stroke, a direction of a linear damping stroke of said first piston extending substantially parallel relative to said linear damping stroke of said second piston.

21. The furniture hinge of claim 1, wherein said transmission mechanism includes a rotatably mounted lever motionally coupled to said actuating element.

22. The furniture hinge of claim 21, wherein said piston of said linear damper is movable by said lever.

23. The furniture hinge of claim 21, wherein said piston of said linear damper comprises a first piston, said linear damper further including a second piston, said lever comprises a double-armed lever having a first lever arm cooperating with said first piston and a second lever arm cooperating with said second piston.

24. An article of furniture comprising:

a furniture body;

a movable furniture part; and a furniture hinge for movably mounting said movable furniture part to said furniture body, said furniture hinge including:

a fitment portion;

a hinge lever;

a hinge cup pivotally connected to said fitment portion by said hinge lever, said hinge lever being connected to said hinge cup by a hinge axis;

a damping device comprising a linear damper arranged at an outside surface of said hinge cup, and said linear damper including a linearly displaceable piston;

an actuating element configured to actuate said damping device so as to dampen a relative movement between said fitment portion and said hinge cup, said actuating element being entirely and continuously arranged within said hinge cup, said actuating element being pivotally mounted so as to be rotatable about an axis of rotation extending substantially parallel to said hinge axis of said hinge cup;

a transmission mechanism configured to convert a rotary movement of said actuating element into a linear movement of said piston of said linear damper; and a housing, said linear damper being arranged within said housing, said housing being fitted onto an outer surface of said hinge cup so as to be insertable jointly with said hinge cup within a cylindrical bore formed in one of said furniture body and said movable furniture part.

* * * * *